US005090211A

United States Patent [19]

Peters

[11] Patent Number: 5,090,211

[45] Date of Patent: Feb. 25, 1992

[54] REFRIGERANT RECOVERY AND RECYCLING SYSTEM

[75] Inventor: Raymond L. Peters, Jefferson City, Mo.

[73] Assignee: ReKlame, Inc., Jefferson City, Mo.

[21] Appl. No.: 491,492

[22] Filed: Mar. 12, 1990

[51] Int. Cl.[5] ..... F25B 45/00

[52] U.S. Cl. ..... 62/149; 62/292; 62/470; 62/513

[58] Field of Search ..... 62/149, 77, 126, 127, 62/129, 84, 85, 195, 292, 470, 471, 513, 113

[56] References Cited

U.S. PATENT DOCUMENTS

| | | | |
|---|---|---|---|
| 3,232,070 | 2/1966 | Sparano | 62/292 X |
| 3,263,435 | 8/1966 | Endress et al. | 62/84 |
| 3,272,735 | 9/1966 | Schneider | 208/341 |
| 3,778,984 | 12/1973 | Lawser | 55/333 |
| 3,945,216 | 3/1976 | Schibbye | 62/84 |
| 4,285,206 | 9/1981 | Koser | 62/126 |
| 4,310,338 | 1/1982 | Schumacher et al. | 62/470 |
| 4,312,187 | 1/1982 | Myers | 62/84 |
| 4,441,330 | 4/1984 | Lower et al. | 62/149 |
| 4,476,688 | 10/1984 | Goddard | 62/149 |
| 4,539,817 | 9/1985 | Staggs et al. | 62/149 |
| 4,646,527 | 3/1987 | Taylor | 62/85 |
| 4,766,733 | 8/1988 | Scuderi | 62/77 |
| 4,768,347 | 9/1988 | Manz et al. | 62/149 |
| 4,776,174 | 10/1988 | Rich et al. | 62/77 |
| 4,805,416 | 2/1989 | Manz et al. | 62/292 |
| 4,809,515 | 3/1989 | Houwink | 62/149 |
| 4,809,520 | 3/1989 | Manz et al. | 62/292 |
| 4,856,289 | 8/1989 | Loufland | 62/149 |
| 4,862,699 | 9/1989 | Lounis | 62/84 |
| 4,903,499 | 2/1990 | Merritt | 62/149 |
| 4,909,042 | 3/1990 | Proctor et al. | 62/149 |

FOREIGN PATENT DOCUMENTS

| | | | |
|---|---|---|---|
| 0038018 | 10/1981 | European Pat. Off. | 62/470 |

*Primary Examiner*—Harry B. Tanner
*Attorney, Agent, or Firm*—Richard J. Grundstrom

[57] ABSTRACT

A recovery, filtering, and purification, and recycling apparatus and system for use with air conditioners, heat exchangers and the like, has a separator with an associated heat exchanger for vaporizing refrigerant within the separator.

9 Claims, 4 Drawing Sheets

REFRIGERANT RECOVERY AND RECYCLING SYSTEM

The present invention relates to a device for recovery, filtering, and purification, and recycling refrigerant from air conditioners, heat exchangers and the like.

BACKGROUND OF THE INVENTION

Currently, refrigerants such as refrigerant 12, 22, 500 and 502 are extensively used in air conditioners and heat exchangers in cars, trucks, homes, commercial buildings and wherever a refrigeration unit operates. The political atmosphere in the United States and world wide is limiting the production of these refrigerants. It is believed by some that the release of halogens, such as contained in refrigerants 12, 22, 500 and 502, are harmful and have a deleterious effect on the ozone layer which surrounds and protects the earth from ultraviolet solar radiation.

As such, the supply of refrigerant is limited and the demand high. Therefore, there is an increasing demand for a unit or device that will recover refrigerant, from an air conditioner, heat exchanger or the like, filter, clean and recycle the refrigerant. Typically, without such a unit or device an air conditioner or heat exchanger undergoing a repair is vented to the atmosphere. Thereby, wasting the refrigerant, and resulting in extra costs to replace the refrigerant and potentially contributing to the harmful effects of halogens in the ozone layer.

In the prior art there are several types of systems available in this area. U.S. Pat. No. 4,261,178 discloses a basic recovery system in which the input of a compressor is coupled through an evaporator to the system to be evacuated and the output connected through a condenser to a refrigerant storage tank. The condenser and evaporator are combined in a single assembly through which air is circulated by a fan.

Manz et al., U.S. Pat. No. 4,805,416, discloses a complicated system in which various configurations recover refrigerant, purifies recovered refrigerant for removal of water and other contaminants, storage of used and/or purified refrigerant and recharging of a refrigeration system such as air conditioning and heat pump systems.

In Manz et al., supra, the input of a compressor is coupled through a filter unit and an evaporation section of a combined heat exchanger/oil separation unit to the refrigeration unit in which the refrigerant is to be recovered. The output of the compressor is coupled, through a condenser contained within the combined heat exchanger/oil separation unit, to a refrigerant storage tank. The refrigerant storage tank is situated on a scale having a pressure switch to indicate when the tank is filled by combining the total weight of the tank and refrigerant.

All filtering occurs in the filtering unit when the refrigerant is in a vapor form. A number of manual and electrically operated valve re-configure the device for various modes of operation. A vacuum pump is provided to evacuate the system during recharging.

These and other systems are presently known. Most systems having filtering capabilities contain independent filter units, as in Manz et al., and those having oil separators are based upon capturing the oil in the liquid phase within an oil separator by withdrawing vapor. In these systems some oil and contaminants are carried by the refrigerant in the vapor phase. The filter unit then further filters out the oil and contaminants.

The systems are often large and bulky and not suitable to transport to all job sites.

Other systems use a heat process to separate the oil from the refrigerant. These systems often operate at high temperature and can be dangerous.

Accordingly, it is the object of the present invention to provide a high efficiency refrigerant recovery and recycling system.

Another object of the present invention is to provide a refrigerant recovery and recycling system which is totally portable and can be easily transported to any job site.

A further object of the present invention is to provide a refrigerant recovery and recycling system which utilizes relatively low temperatures and a high efficiency filtering process to remove oil, moisture and sediment from the recovered refrigerant.

Still another object of the present invention is to provide a refrigerant recovery and recycling system which is easy to operate without complicated manipulation of controls either manually or electrically.

Still another object of the present invention is to provide a refrigerant recovery and recycling system which is highly reliable including only a few, easily serviced components.

Another object of the present invention is to provide a refrigerant recovery and recycling system which safely and reliably determines when a refrigerant storage tank is filled.

SUMMARY OF THE INVENTION

To accomplish the foregoing and other objects of this invention there is provided a refrigerant recovery and recycling system. In particular there is provided a refrigerant recovery and recycling system in which the input to a compressor is connected through a crankcase pressure regulator and a unique oil separator/moisture separator filter combination, to either a liquid or vapor phase of a refrigeration unit in which the refrigerant is to be recovered.

The output of the compressor is connected, through a coil in heat exchange contact with the oil/moisture separator filter combination, air cooled condenser and a removable spin on secondary filter, to a refrigerant recovery bottle. The refrigerant recovery bottle and refrigerant oil and recycling system having a means to terminate recovery operations when the bottle is properly filled to the "full" level.

In operation a high degree of efficiency in removing moisture and oil from a recovered refrigerant is achieved in the initial recovery operation. This eliminates the need for additional purification or filtering of the refrigerant in most cases. However, additional purification and filtering can be provided by this system.

In operation, the refrigerant recovery and recycling system is connected to a liquid or vapor phase of a refrigeration unit in which the refrigerant is to be recovered. It is connected using the manifold gauges and hoses normally used during service of a unit.

The vapor input is directed by suitable piping or tubing directly into an oil/moisture separator filtering unit. The output of this combined unit is lead to the input of a compressor. The compressor provides a suction and creates a differential pressure within the oil/moisture separator filtering unit. As the vapor enters the unit the vapor expands. The expansion creates a drop in temperature. As the temperature drops any moisture freezes and any oil thickens.

A baffle and filtering means is provided within the oil/moisture separator filtering unit between the input and output. As the vapor is drawn to the output the frozen moisture and thickened oil is stopped by the baffle and filtering means. The frozen moisture and thickened oil collect at the bottom of the unit and is removed with a valved oil drain.

A crankcase pressure regulator is provided to prevent overpressurization and damage to the compressor at the input of the compressor.

The output of the compressor is in communication with a heat exchanger assembly located on the exterior of the oil/moisture separator filtering unit. Here the compressed refrigerant releases energy as heat. This assists in the condensation of the refrigerant within the exchanger and prevents the oil/moisture separator filtering unit from becoming too cold to operate properly.

The output is then conducted through an air cooled condenser where the refrigerant temperature is further reduced, through a secondary filter and finally to a refrigerant recovery bottle.

The liquid input follows the same path except that before entering the oil/moisture separator filtering unit the liquid enters through a thermal expansion valve. This valve lowers the pressure of the liquid substantially so that the liquid begins to flash. Any liquid which enters the oil/moisture separator filtering unit "boils". The expansion and "boiling" causes a drop in temperature and the vapor follows the path as described above.

The refrigerant recovery bottle contains a full level switch which is connected to an interlock system in the refrigerant recovery and recycling system. This arrangement is intended to shut down the refrigerant recovery and recycling system when the bottle is full, to prevent over filling and pressurization.

The intent is to allow the user to recover and recycle the refrigerant for reuse. This would be an alternate to allowing the refrigerant to be purged off into the atmosphere and replaced by new refrigerant. The obvious advantage to this is that the refrigerant being reused is a savings to the owner and to the service people not having to buy new refrigerant and pass on the cost to the end user.

Another feature of the present invention is the answer it provides in response to the new regulations requiring the recovery of refrigerant and not allowing the refrigerant to escape. Recovering refrigerant would be one process and that refrigerant then could be turned in for disposal or sent back to a company who might be able to clean it up and make it available for reuse. But this unit will also recycle the refrigerant. It brings a refrigerant from the container that it is recovered to and brings that refrigerant back through the recovered part of the system.

These and other objects and features of the present invention will be better understood and appreciated from the following detailed description of the main embodiment thereof, selected for purposes of illustration and shown in the accompanying drawings.

DETAILED DESCRIPTION

Figure 1:
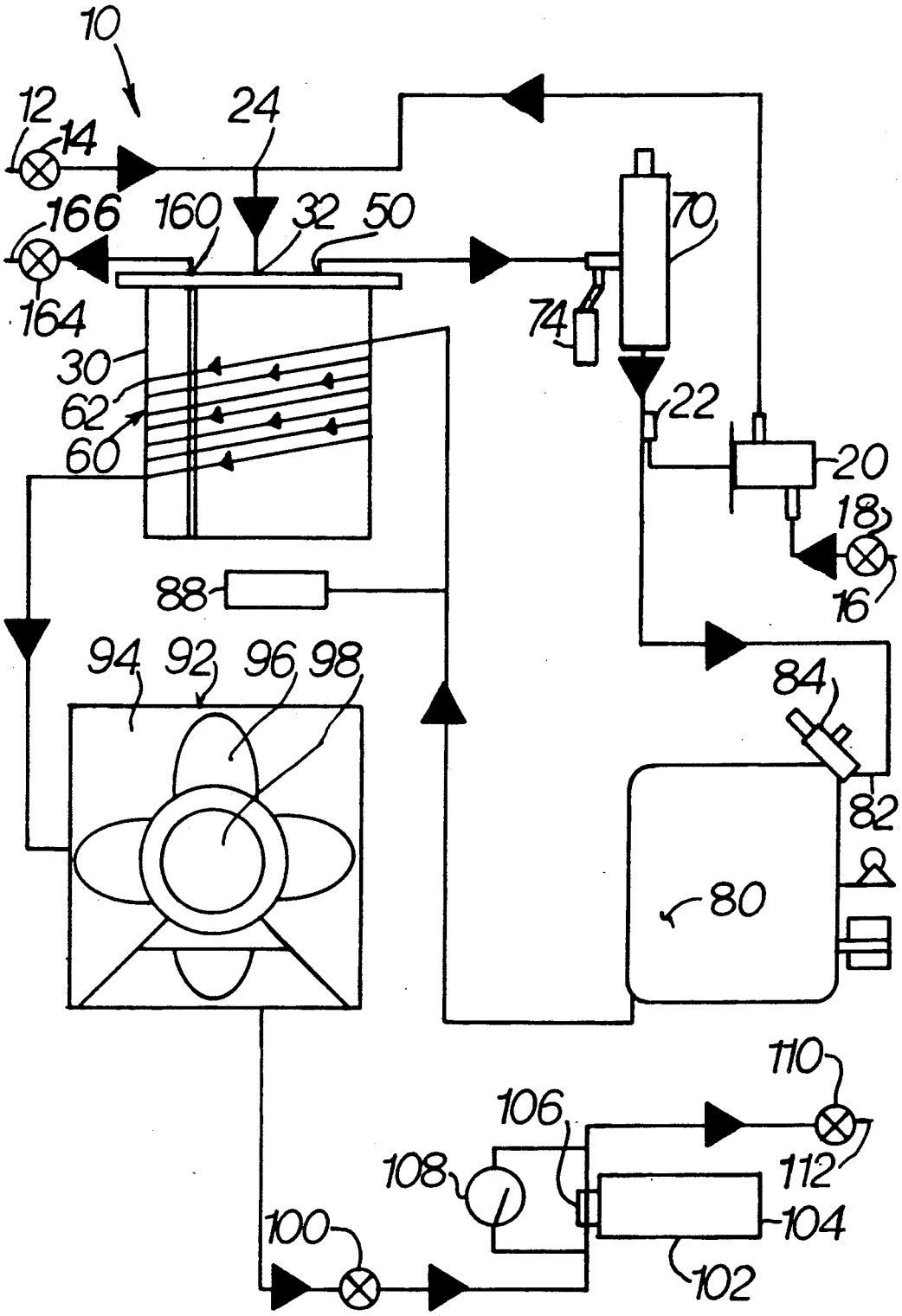
FIG. 1 is a schematic diagram of a refrigerant recovery system in accordance with the present invention.

Referring now to the drawings then there is shown one preferred embodiment for the refrigerant recovery and recycling system of this invention. Other embodiments may be described when applicable.

There is provided a refrigerant recovery and recycling system 10 for use in recovering refrigerants 12, 22, 500 and 502 from refrigeration units such as used on air conditioners and heat exchangers, filtering and purifying moisture, oil and other contaminates from the recovered refrigerant and recycling the recovered refrigerant for reuse.

FIG. 1 illustrates the present preferred embodiment of a refrigerant recovery and recycling system 10. The system 10 can be used to recover refrigerant in either the vapor or liquid phase. As such, there is provided a vapor input 12 having a vapor input valve 14 and a liquid input 16 having a liquid input valve 18.

The system 10 is typically connected to the refrigeration unit by a service manifold gauge and hose combination. The manifold hose typically have a female threaded receptacle which fit onto the threaded male fittings on the liquid input 16 and vapor input 12.

As a liquid refrigerant enters the system, via liquid input valve 18, the liquid refrigerant passes through an expansion valve 20. This expansion valve 20 lowers the pressure of the liquid substantially so that the liquid begins to flash. As the liquid is flashing, or boiling, the liquid is substantially converted to a vapor.

The pressure reduction created by the expansion valve 20 is controlled by a liquid filled temperature sensing bulb 22 in the preferred embodiment. In other embodiments the pressure reduction control may be fixed or controlled by other factors and other devices, the liquid filled temperature sensing bulb 22 monitors the temperature of the compressor input 82.

The vapor and any remaining liquid exiting the expansion valve 20 enters a "T" fitting 24. Also, the vapor entering the system 10 via the vapor input 12 through the vapor input valve 14 enters the "T" fitting 24. At this point the inputs 12, 16 are combined and the remainder of the system 10 is applicable to either vapor or liquids input to the system 10.

The "T" fitting 24 combined the vapor and liquid into a common line so that both vapor and liquid enter into a combined oil/moisture separator filtering unit 30 at input 32.

Figure 2:
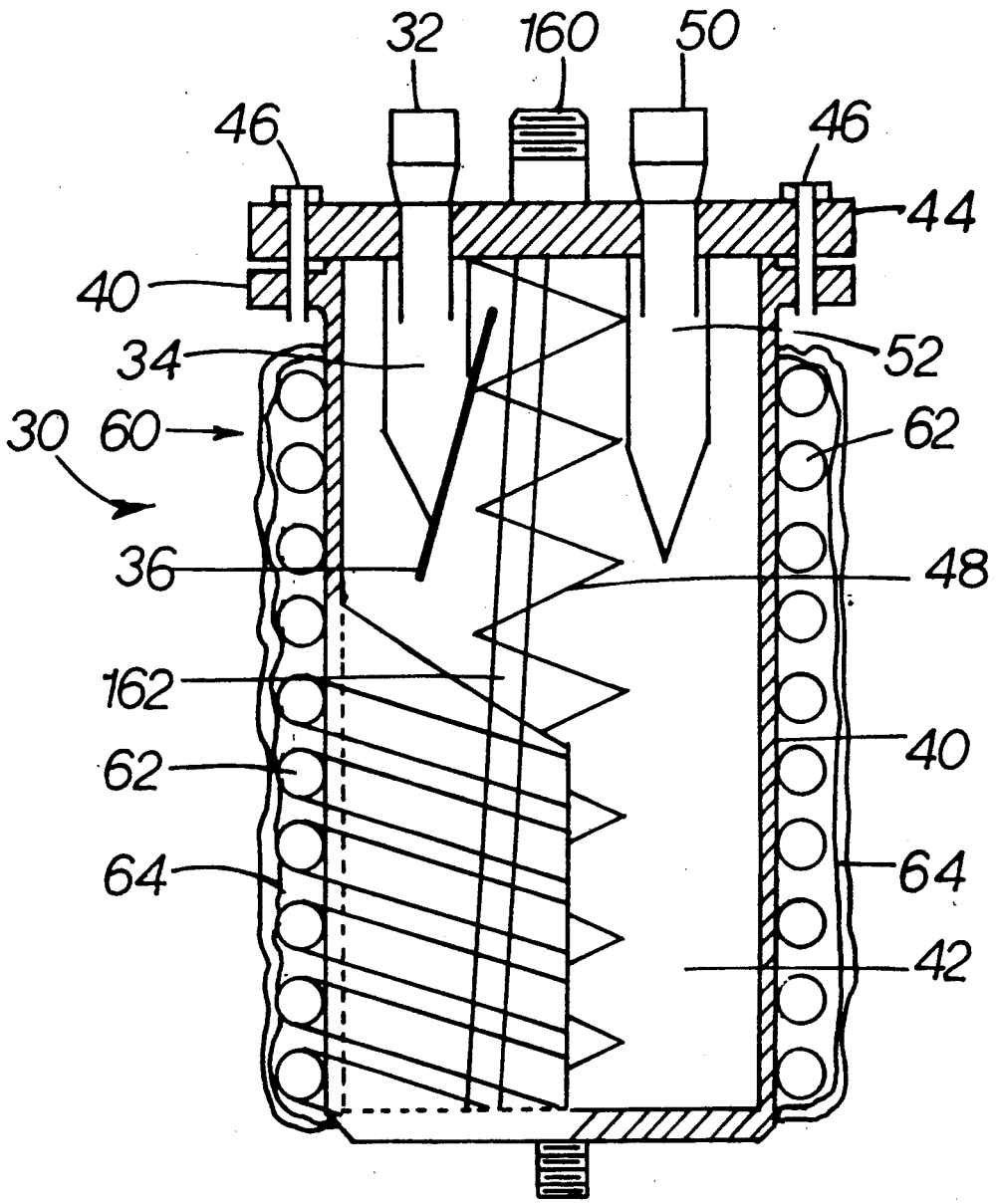
FIG. 2 is a schematic diagram of a separation unit constructed in accordance with the present invention partially cut away to show particular features of the construction.
Figure 3:
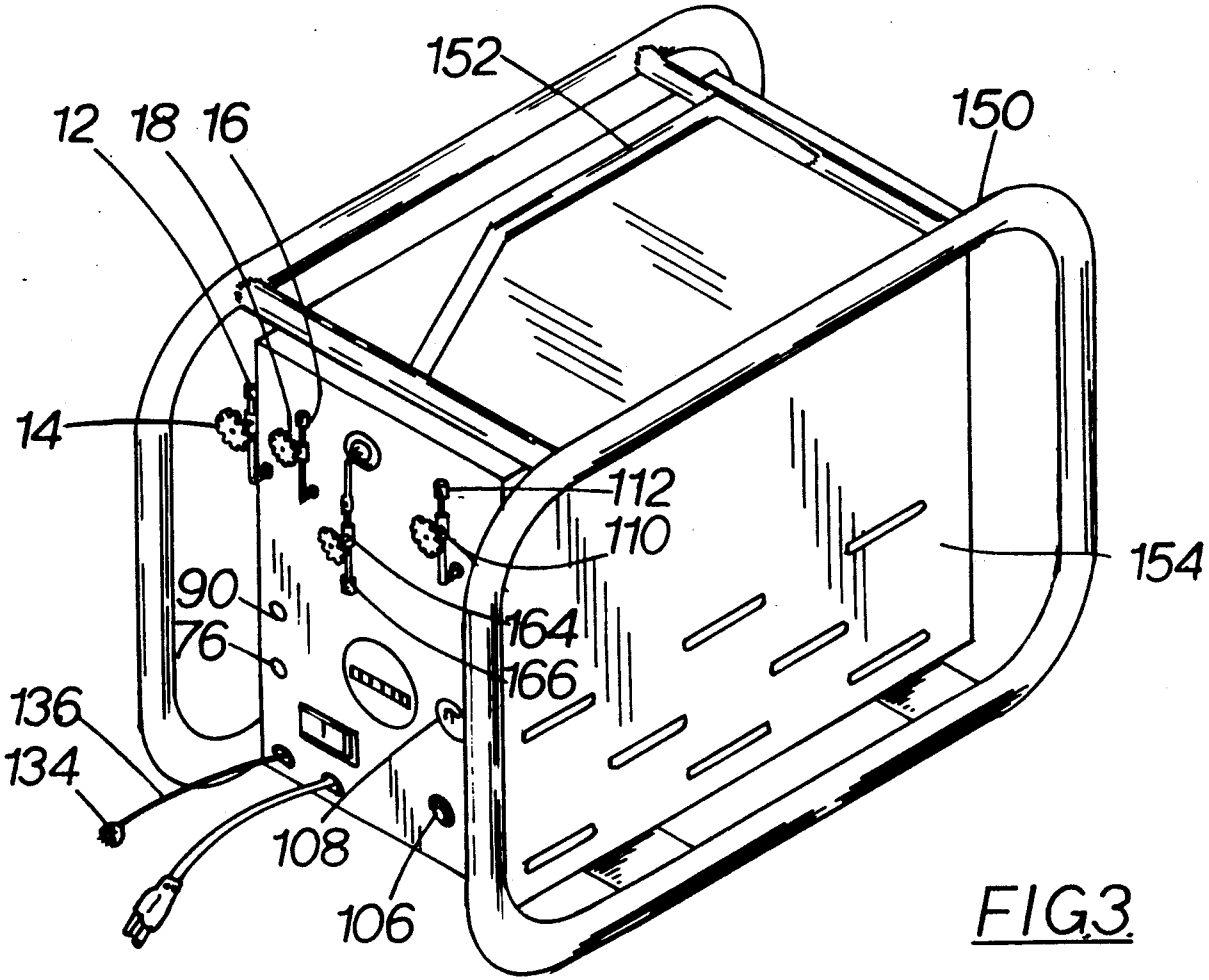
FIG. 3 is a view of a control panel for an apparatus incorporating the present invention.

Referring now to FIG. 2, a novel and unique oil/moisture separator filtering unit 30 is provided. Refrigerant, either vapor or liquid, enters the unit 30 at the input port 32. The refrigerant passes through a brass wire mesh 34 which acts to dispense the refrigerant into a separation chamber 42 and provides a trap for any large particulate matter.

Any liquid which enters the unit 30 generally drops to the bottom of the separation chamber 42 and "boils" off. The boiling of the refrigerant creates a vapor which joins other vapor in the separation chamber 42. The expansion of the refrigerant, created by the boiling, lower the temperature within the separation chamber 42.

A differential in pressure within the separation chamber 42 between the input port 32 and an output port 50 is created by the output port 50 being connected to the input 82 to a compressor 80. The compressor 80 creates a low pressure at the input port 50 which draws the vapor from the input port 32 to the output port 50. The differential in pressure and the volume of the separation chamber 42 allows the vapor to expand. The expansion of the vapor causes a temperature drop.

Due to the decrease in temperature created by the "boiling" of any liquid refrigerant and the expansion of the vapor, the moisture in the refrigerant freezes and any oil becomes thick and heavy. A series of screens and oil separating baffles 48 are contained within the separation chamber 42 of unit 30 between the input port 32 and the output port 50. As the vapor is drawn towards output port 50 it must pass through the series of screens and oil separating baffles 48. The oil and frozen moisture are stopped by the series of screens and oil separating baffles 48.

The oil and moisture crystals that are collected on the series of screens and oil separating baffles 48 are allowed to drip to the bottom of the separation chamber 42. The oil collected at the bottom of the separation chamber is drawn out through a dip tube 162 which extends from the oil output port 160 to the bottom of the separation chamber 42, and through the oil drain valve 164 and out the oil drain 166.

The separation chamber 42 is at a pressure higher than atmosphere's pressure when in operation, therefore, by opening the oil drain valve 164 any oil collected at the bottom of separation chamber 42 will be forced out through the dip tube 162.

A galvanized shield 36 on the brass wire mesh 52 for the input port 32 help dispense the refrigerant as it enters the separation chamber 42 and prevents the refrigerant from passing through a localized area of the series of screens and oil collecting baffles 48.

Physically, the separation chamber 42 is defined by a refrigerant receiver 40 and cap 44. In the preferred embodiment as illustrated, the refrigerant receiver 40 is cylindrical having a closed end. The cap 44 having the output port 50, oil output port 160 and input port 32, defines the upper boundary of the separation chamber 42 and closes the open end of refrigerant receiver 40. The cap 44 is generally secured to the refrigerant receiver by bolts 46 but any acceptable fasteners in the art may be utilized.

A heat exchanger assembly 60 consisting of a continuous heat tube 62 is wrapped around and in contact with the refrigerant receiver 40 and covered with insulation 64. The purpose of the heat exchanger assembly is two fold. First, compressed and heated refrigerant is being passed through the heat tube 62. The cold temperature within the separation chamber 42 is conducted through the refrigerant receiver 40 to the heat tubes 62. This provides a cooling effect on the refrigerant passing through the heat tube 62 and assists in condensing the refrigerant.

Secondly, heat is transferred from the refrigerant passing through the heat tube 62, to the refrigerant receiver 40. This heat helps maintain temperatures within the separation chamber 42 sufficient for any liquid refrigerant to boil or vaporize.

Referring now to FIG. 1, the refrigerant as it exits the oil/moisture separator filtering unit 30 enters a crankcase pressure regulator 70. On a hot sunny day the internal pressure within the refrigeration unit on which the refrigerant is to be recovered may exceed 100–200 pound per square inch. The purpose of the crankcase pressure regulator 70 is to reduce these high pressures to a safe operating pressure for the compressor 80.

The refrigerant after passing through the crankcase pressure regulator 70 enters the compressor 80 through a service valve 84 at the input point 82. The compressor 80 is a standard compressor known in the art. Generally, the compressor is a reciprocal compression system having a motor crank, piston assembly and suction disk charge valve.

The compressor 80 compresses the refrigerant vapor to a very high pressure and temperature. Depending on the type of refrigerant the pressure may be as high as 250–300 PSI.

Typically, compressors are lubricated by oil contained within the refrigerant. In this instance the refrigerant entering compressor 80 is void, or at a very low-concentration of oil. The oil being removed by the oil/moisture separator filtering unit 30. Therefore, the compressor requires an internal lubricant. Typically 18–20 ounces of oil is added to the compressor. During use, this oil becomes deteriorated and contaminated.

In this preferred embodiment, the service valve 84 is such that the oil may be changed in the compressor by opening an oil drain on the valve 84 and tipping the compressor in its side to allow the oil to drain. Fresh oil can then be added through the oil drain when the compressor is set upright.

The compressed and heated refrigerant after exiting the compressor enters the heat exchanger assembly 60 on the oil/moisture separator filtering unit 30. Here the temperature of the refrigerant is reduced as described above. The somewhat cooled and condensed refrigerant exits the heat exchanger assembly 60 and enters an air cooled condenser 92.

The air cooled condenser 92, generally, is made from standard items in the art, consisting of a condenser 94, motor 98 and motor driven fan blade 96. Other methods and equipment to condense the refrigerant may be utilized without departing from the inventive concept as illustrated and described in this preferred embodiment.

The refrigerant is subcooled and completely condensed to a liquid in the condenser. The temperature of the liquid refrigerant is reduced to approximately 10 degrees above the ambient temperature.

The liquid refrigerant leaves the condenser 90 through a condenser discharge valve 100 and enters a filter assembly 102. The filter assembly provides an additional and secondary filtering for any contaminates which may have passed through the oil/moisture separator filtering unit 30. The filter assembly 102 consists of a spin on filter 104 which is available in various sizes ranging from 8 to 30 cubic inches, a visual indicator 106, and a pressure differential gauge 108.

The visual indicator 106 is provided to give the operator a visual indication as to the quality of the refrigerant. The visual indicator provides a change in color as the acid and moisture content of the refrigerant changes. If the refrigerant is dry as indicated by the visual indicator 106 it will be alright for reuse. If the refrigerant contains moisture as indicated on the visual indicator 106 the refrigerant will have to be recycled to reduce the moisture content before reuse.

A pressure differential gauge 108 is provided across the input and output of filter. This provides an indication of the condition of the filter and indicates when the filter must be changed. As the filter becomes more dirty or clogged the pressure differential across the input and output increases. When the pressure reaches a given point the filter should be changed.

The refrigerant exits the filter assembly 102 and exits the refrigerant recovery and recycling system 10 via the liquid output 112 through liquid output valve 110.

The refrigerant recovery and recycling system 10 is provided with a high pressure control 88 and a low pressure control 74. The high pressure control 88 monitors the output 86 of the compressor 80. This is a safety device to shut down the refrigerant recovery and recycling system 10 if for some reason a high pressure were developed. When the system 10 is shut down for high pressure a visual indicator light 90 is lighted to alert the operator.

The high pressure control 88 automatically resets so that once the reason for the high pressure has been eliminated the system 10 will restart.

The low pressure control 74 monitors the output of the oil/moisture separator filtering unit 30. When a low pressure is encountered the low pressure control 74 shuts down the system 10 and a low pressure visual indicator light 76 is lighted to alert the operator. This low pressure control 74 provides a means to shut the system 10 down when all the refrigerant has been recovered from a refrigeration unit.

During a normal recovery process, the operator need only to connect the refrigerant recovery and recycling system 10 to the refrigeration unit on which the refrigerant is to be recovered and go on about whatever work he needs to do. Whenever all the refrigerant has been evacuated the system 10 will shut itself down.

The low pressure switch automatically resets itself so that if the pressure increases the system 10 will turn itself back on to continue recovery operations. This is advantageous in that if the system 10 remains connected to the refrigeration unit being evacuated the system will start back up if some residual refrigerant remains and the pressure increases due to the refrigerant boiling off after the initial shut down. This results in additional refrigerant recovery.

Figure 4:
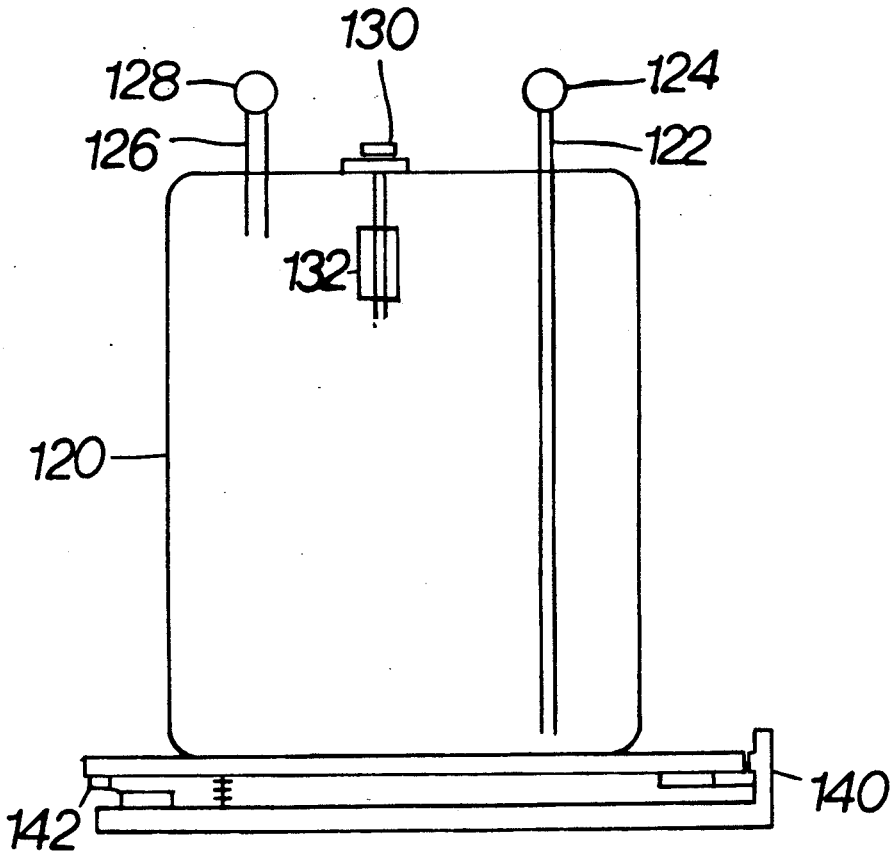
FIG. 4 is a schematic diagram of a weight detection system.

A refrigerant storage tank 120 is also included as a part of the refrigerant recovery and recycling system 10. Referring to FIG. 4, the refrigerant storage tank 120, is the typical dual part tank commercially available. The storage tank 120 typically has a liquid port 122, liquid port valve 124, a vapor port 126 and a vapor port valve 128. However, the refrigerant recovery and recycling system 10 also includes a full level indicator switch 130 within the storage tank 1.

The full level indicator switch 130 is typically a spring assisted float which operates a sealed micro switch 132 as the liquid reaches the full level. The full level indicator switch 130 is electrically connected to the refrigerant recovery and recycle system via an electrical cord 136 and plug 134. When the tank 120 reaches the full level the switch 130 operates to shut down the refrigerant recovery and recycling system 10. This prevents over filling and over-pressurizing the refrigerant storage tank 120.

Means other than the preferred embodiment of the full level indicator switch, may be utilized without departing from the inventive concept. Typically, in the art and what may be used as an alternative, is a scale 140 having a pressure sensitive switch 142.

In the illustrated arrangement the pressure sensitive switch 142 is operated when the combined weight of the tank 120 and refrigerant being added to the tank reaches a predetermined weight. The total combined weight is in proportion to the level of the refrigerant within the tank. The switch 142 in this means would also operate to shut down the system 10.

The refrigerant recovery and recycling system 10 provides a high efficiency filtering and purification of the refrigerant as it is being recovered. However, if the visual indicator 106 indicates the refrigerant is not suitable for reuse, the refrigerant can be recycled through the system 10 for additional filtering and purification. The refrigerant can be continuously recycled as long as it takes to clean the refrigerant for reuse.

To provide recycling, the refrigerant recovery and recycling system 10 is connected to the refrigerant storage tank. The liquid input 16 is connected to the liquid port 122 on the storage tank 120. The liquid output 112 is connected to the vapor port 126 of storage tank 120. Once connected, the liquid input valve 18, liquid output valve 110, vapor port valve 128 and liquid port valve 124 are opened.

The system 10 is started and operated as described above. The liquid refrigerant is drawn from the bottom of the tank 120 and is returned to the top of the tank 120. In this configuration the refrigerant can be continuously recycled.

The refrigerant recovery and recycling system 10 can also be used to recharge the refrigerant system in which the refrigerant was just recovered or a completely separate refrigeration unit. The refrigerant is pumped into the refrigeration unit under pressure so that the entire amount of refrigerant that has been recovered and recycled can be replenished into the unit without going through a normal charging procedure.

The normal charging procedure requires trying to get the refrigerant out of the bottle at saturation pressure and metering the amount of refrigerant transferred. Also during the normal charging procedure the storage tank often dramatically drops in temperature. When this happens, the operator typically places the storage tank in a drum or bucket of hot water to elevate the temperature and pressure of the storage tank so that the refrigerant can be withdrawn.

With the refrigerant recovery and recycling system 10 of this invention the refrigerant is drawn out of the storage tank and injected under pressure into the refrigerant unit resulting in an extra time saving advantage.

During recharging the refrigerant recovery and recycling system 10 is connected to the refrigeration unit to be recharged by connecting the liquid input 16 to the liquid port 122 on the refrigerant storage tank 120 and the liquid output 112 to the refrigeration unit to be recharged. Once connected and the associated valves are opened the system is turned on. The system will again operate as described above.

All the components of the refrigerant recovery and recycling system 10 as described above, except the refrigerant storage means, are contained within a housing 154. All the controls, indicators, inputs, outputs and valves are located on a control panel located on the housing 154. This feature provides for easy operation and convenience to the operator. A tubular cage 150 surrounds the housing and controls. A handle 152 is provided as part of the cage 150 to carry and transport the refrigerant recovery and recycling system to the job site.

Typically, a unit such as this would be used with other equipment and supplies all carried together in a service truck. The cage 150, therefore, is designed to protect the refrigerant recovery and recycling system and control panel from such rough handling. The cage 150 also acts as a roll bar to protect the control panel and housing. Typically the cage 150 is made from tubular aluminum, but other materials could be substituted.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A refrigerant recovery and recycling system comprising:

a combined oil separator, moisture separator, and filtering means having an input connected to a refrigeration unit in which the refrigerant is to be recovered;

a compressor means having an output and an input which is connected to the output of the combined oil separator, moisture separator and filtering means, a condensing means having an input connected to the output of the compressor means and an output;

an expansion valve connected to the input of the combined oil separator, moisture separator and filtering means; and a refrigerant storage means connected to the output of the condensing means for the collection and storage of refrigerant recovered from a refrigeration unit.

2. The refrigerant recovery and recycling system as set forth in claim 1 wherein the combined oil separator, moisture separator, and filtering means comprises:

a refrigerant receiver having a closed end and an open end;

a cap having an input port, an output port and an oil output port secured to the refrigerant receiver open end thereby defining a closed chamber; and a series of screens and baffles within the closed chamber separating the input port and output port.

3. The refrigerant recovery and recycling system as set forth in claim 2 wherein the combined oil separator, moisture separator and filtering means further includes a heat exchanger assembly wrapped around and in heat exchange contact with the refrigerant receiver whereby heat is transferred to the refrigerant receiver and a reduction of temperature occurs within the heat exchanger assembly.

4. The refrigerant recovery and recycling system as set forth in claim 1 in which said refrigerant recovery and recycling system further comprises a refrigerant recovery and recycling system which can be used to recover and recycle multiple types of refrigerant, in which the multiple refrigerants includes refrigerants 12, 22, 500, and 502.

5. The refrigerant recovery and recycling system as set forth in claim 1 in which said refrigerant storage means further comprises a spring assisted float contained within said storage means; and a sealed micro switch, said micro switch being operated by said float, and further being electrically connected to said refrigerant recovery and recycling system to terminate recovery operation when operated upon by said float.

6. The refrigerant recovery and recycling system as set forth in claim 1 in which the compressor means further comprises a service valve contained on said compressor means, said service valve providing a means to change the oil in said compressor means.

7. A refrigerant recovery and recycling system comprising:

a combined oil separator, moisture separator and filtering apparatus having a separations chamber defined by a refrigerant receiver and cap, an input and output having a differential in pressure such that a refrigerant is drawn into the input from a refrigeration unit in which the refrigerant is being recovered through the separation chamber and out the output, and a series of screens and baffles within the separation chamber between the input and output such that the refrigerant drawing into the separation chamber must pass through the series of screens and baffles prior to exiting via the output, and having a wire mesh screen on said input within said separations chamber to dispense refrigerant as it enters said chamber and a shield on said wire mesh screen to prevent localized passage of refrigerant through said series of screens and baffles;

an expansion valve at the input to the combined oil separator, moisture separator and filtering apparatus to vaporize liquid refrigerant entering the system;

a compressor means having an input coupled to the output of the combined oil separator, moisture separator and filtering apparatus;

a low pressure control between the output of said combined oil separator, moisture separator and filtering apparatus and said input compressor means to monitor the pressure such that whenever a preselected low pressure is encountered the refrigerant recovery and recycling system will shut itself down;

a high pressure control on the output of said compressor means to monitor the pressure such that whenever a preselected high pressure is encountered the refrigerant recovery and recycling system will shut itself down;

a heat exchanger assembly having an input connected to the compressor means output, said heat exchanger assembly being wrapped around and in heat exchange contact with the refrigerant receiver;

a condensing means having an input connected to the output of the heat exchanger assembly to condense and cool refrigerant;

a filter assembly having an input connected to the output of the condensing means consisting of a filter, a visual indicator for determining quality of refrigerant and a pressure differential gauge to indicate condition of filter and an output from refrigerant recovery and recycling system; and a refrigerant storage means to accept and store refrigerant from the output of said refrigerant recovery and recycling system, having a spring assisted float contained within said storage means, and a sealed micro switch, said micro switch being operated upon by said float and being electrically connected to said refrigerant recovery and recycling system to terminate recovery operation when operated upon by said float.

8. A refrigerant recovery and recycling system as set forth in claim 7 further comprising a protective cage receiving a component housing and the components of the refrigerant recovery and recycling system housed substantially therein, the cage protecting an associated control panel and providing a transportation handle for refrigerant recovery and recycling system.

9. A method of separating moisture, oil, and other contaminants from recovered refrigerant in a refrigerant recovery and recycling system, comprising:

drawing refrigerant into a separation chamber through an input of a combined oil separator, moisture separator, and filtering unit by creating a low pressure at the separator chamber output, a means for compressing the refrigerant providing the low pressure;

maintaining a temperature within the separation chamber sufficient to vaporize the refrigerant; vaporizing any liquid refrigerant entering the separation chamber;

reducing the separation chamber temperature as a result of the refrigerant vaporization and refrigerant expansion within the separation chamber;

freezing moisture within the separation chamber as a result of the temperature reduction within the separation chamber;

thickening oil within the separation chamber as a result of the temperature reduction within the separation chamber; and separating the frozen moisture and thickened oil from the refrigerant.

* * * * *